US006260244B1

(12) United States Patent
Noda

(10) Patent No.: US 6,260,244 B1
(45) Date of Patent: Jul. 17, 2001

(54) PLASTIC CLIP

(75) Inventor: Taizoh Noda, Nishinomiya (JP)

(73) Assignee: J-Sen Limited, Kyoto (JP)

( * ) Notice: Subject to any disclaimer, the term of this patent is extended or adjusted under 35 U.S.C. 154(b) by 0 days.

(21) Appl. No.: 09/413,537

(22) Filed: Oct. 6, 1999

(30) Foreign Application Priority Data

Nov. 5, 1998 (JP) ..... 10-332089

(51) Int. Cl.[7] ..... A44B 21/00
(52) U.S. Cl. ..... 24/499; 24/504
(58) Field of Search ..... 24/499, 503, 504, 24/515, 516

(56) References Cited

U.S. PATENT DOCUMENTS 5,400,483 3/1995 Noda .
5,778,497 7/1998 Noda .

FOREIGN PATENT DOCUMENTS 1 588 956 5/1978 (GB) .
2 247 483 9/1995 (GB) .

*Primary Examiner*—James R. Brittain
(74) *Attorney, Agent, or Firm*—Snider & Associates; Ronald R. Snider

(57) ABSTRACT

A compact and smart plastic clip has a recessed auxiliary plate (12) prepared in an upper clipping member (10) which is inserted into a square-like window (5) prepared in a lower clipping member (1). The arcuate bottom (14) is placed on a support shelf, pivot pin receiver holes (25) of an operation member (20) receive pivot pins (4) formed in a pair of side walls (3) for the lower clipping member (1) and is forcibly pressed downward, both top ends of the lower and upper clipping members (1,10) are pinched together in a closed position by elastic power of plastic material. When a rear area of the operation member (20) is moved up the rear wall (15) forcibly presses it onto a tongue-like actuation cam (24). This action causes opening between the lower and upper clipping members by the power of a fulcrum function of the arcuate bottom (14) of the upper clipping member (10).

3 Claims, 8 Drawing Sheets

PLASTIC CLIP

RELATED APPLICATION

This present application claims the priority of Japanese Patent Application Number 10-332089 (filed on Nov. 5, 1999) which is incorporated herein by reference in its entirety.

BACKGROUND OF THE INVENTION

1. Field of the Invention

This invention relates to a plastic clip. The clip is used on clothes such as suspender clips or as a clip attached on the leading end of a waist cloth for closing a Kimono. The clip can also be used as a clothes pin.

2. Description of the Prior Art

The present inventor has already obtained the following two U.S. patents based on similar concepts:

(1) U.S. Pat. No. 5,400,483, and (2) U.S. Pat. No. 5,778,497

U.S. Pat. No. 5,400,483 discloses a plastic clip, wherein metallic pins or metallic springs were not adopted. Instead of pins and springs, an elastic plastic material was utilized. As shown in FIG. 7A and FIG. 7B, this prior art clip is opened or closed when top ends of a lower clipping member (1) and an upper clipping member (10) are operated by an operation member (20). A support shelf (33) is formed at a rear portion of the lower clipping member (1), while a hinge (34) is also formed at a rear portion of the upper clipping member. A cam plate (35) is provided on the operation member (20). When both rear portions of the lower clipping member (1) and the upper clipping member (10) are combined together crossing like the letter X, the cam (35) is pinched between the crossing portion and the rear portion. Thus, the hinge (34) is adapted to engage onto the supporting shelf (33) at a fixed pressure power, so that the top ends of the lower clipping member (1) and the upper clipping member (10) may be opened by elastic power of a plastic material.

U.S. Pat. No. 5,778,497 discloses another plastic clip, wherein the minimum thickness of the clip is attained and at the same time the pressure toward each locking material is ensured. As shown in FIG. 8A and FIG. 8B as another example of Prior Art, an upper clipping member (A) comprises a mouth (38) prepared on an upper surface of a rear portion, a side wall (39) formed on a bottom surface of a rear portion, a spindle plate (40) established in the forward portion of the side wall (39), and a recess bearing (41) prepared on the inside surface of the side wall (39). A lower clipping member (B) comprises a ditch-like bearing (42) on bottom surface of rear portion, a narrow projection (44) having a protuberance (43) on both sides of the rear portion formed, and an elastic tongue (45) extending upward formed on the central portion. An operation member (C) comprises an actuation expansion (48) formed on the outer surface of an outer side wall (46) of a box (47) having the outer side wall (46). This actuation expansion (48) is adapted to fit between the side wall (39) and the projection (44), an engaging dent (49) into which the protuberance (43) fits and a pressure plate (50) provides a little bit rear position from the center of the actuation expansion, and a slit-like belt insertion is prepared at the end portion.

The plastic clip developed by U.S. Pat. No. 5,400,483 has a defect in that the shape of the operation member (20) is easily worn and is found to damage the durability.

The plastic clip developed by U.S. Pat. No. 5,778,497 has improved durability and locking power, but it is still necessary to offer a better quality and long-lasting clip for the market, and as another aspect, the exterior of the clip is unattractive due to the combination between the upper clipping member, the lower clipping member and the operation member.

SUMMARY OF THE INVENTION

The object of the present invention is to provide a better quality plastic clip after resolving various problems existing in prior art.

This applicant has changed the construction of the rear portions and changed the method for combination of an upper clipping member and a lower clipping member as well as adopting a novel operation member. The plastic clip developed by this invention is now furnished with an ensured pressuring power by the operation member for pinching the upper clipping member and the lower clipping member. At the same time, during pinching between the upper and lower clipping members, the actuation cam on the operation member has no affect on a rear wall of the upper clipping member which acts a reaction bar. Therefore, hysteresis wear of the rear wall is avoided, so that the durability is increased.

This invention comprises a plastic clip:

- a lower clipping member (1), an upper clipping member (10), and an operation member (20), wherein a top end of the upper clipping member (10) is opened or closed by operation movement of the operation member (20);
- a square-like window (5) formed on the rear area of the lower clipping member (1);
- a pair of side walls (3) prepared on both sides of the window (5);
- a rear wall (7) lower than the side wall (3) established in the rear area of the window (5);
- an arcuate support shelf (6) formed on central and front areas of the rear wall (7);
- a first pair of arcuate surfaces (8) are prepared on both side ends of the rear wall (7);
- a pair of pivot pins (4) are positioned in front of and higher than the arcuate support shelf (6) and in the inner surfaces of the pair of side walls (3);
- a recessed auxiliary plate (12) is established on the rear area of the upper clipping member (10), which is adapted to be inserted into the square-like window (5);
- a rear wall (15) of the recessed auxiliary plate (12) is formed in an extending shape;
- an arcuate bottom (14), FIG. 3B, corresponding with the arcuate support shelf (6) is prepared on the middle and outside areas of the rear wall (15);
- a second pair of arcuate surfaces (16) corresponding with the first pair of arcuate surfaces (8) of the rear wall (15) are established on both sides of the arcuate bottom (14), FIG. 3B;
- a strap insertion hole (26) is formed in the rear area of the operation member (20);
- a back plate (22) is adapted to be inserted between the pair of side walls (3) prepared in the front area **(23*a*) of the operation member (20)**;
- a top end of a front wall (23) for the back plate (22) provided in arcuate form;
- a tongue-like actuation cam (24) which is almost same height of the front wall (23) top end and which is positioned in some fixed separate distance from the wall (23) established in the central area of the top end of a front wall (23);

a pair of pivot pin receiver holes (25) which receive a pair of the pivot pins (4) formed on both outer sides of the back plate (22);

wherein the recessed auxiliary plate (12) which is now inserted into the square-like window (5) and the arcuate bottom (14) which is placed on the arcuate support shelf (6);

wherein the pivot pin receiver hole (25) of the operation member (20) which is now fitted into the axis (4) in the inside surface of the side wall (3) of the lower clipping member (1) and which is forcibly pressed downward from the upper portion of the recessed auxiliary plate (12);

wherein the top ends of the lower clipping member (1) and the upper clipping member (10) which are pinched together by elastic power of the plastic material at the bottom end of the front wall (23) of the operation member (20) for closing; and wherein the rear area of the operation member (20) moved in the upper area of the rear wall (15) is pressed forcibly on to the rear area at the bottom end of the tongue-like actuation cam (24), which promotes opening the top ends of the lower clipping member (1) and the upper clipping member (10) by the force provided by a fulcrum function of the bottom (14).

This invention further provides a gap (30), FIG. 6B, between the tongue-like actuation cam (24) and an inner surface (18) of the rear wall (15). This device prevents the mutual and direct contact between the rear wall (15) and the actuation cam (24) in order to avoid the hysteresis wear caused by mutual interference therebetween for the durable plastic clip.

DESCRIPTION OF THE PREFERRED EMBODIMENT

Figure 1A:
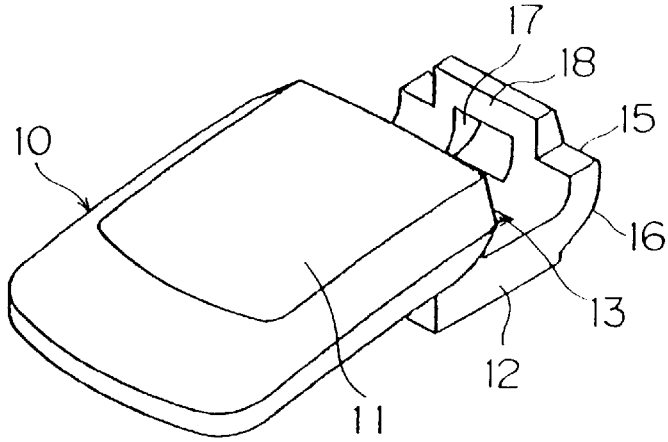
FIG. 1A is an exploded perspective view of an upper clipping member developed by this invention.
Figure 1B:
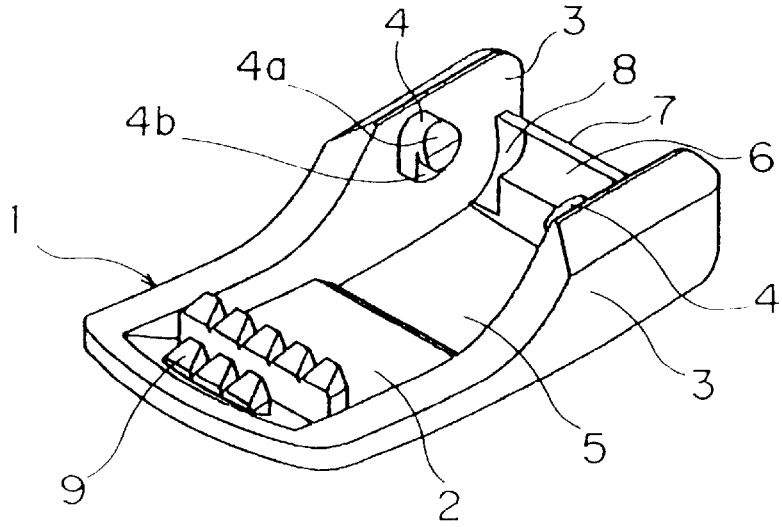
FIG. 1B is an exploded perspective view of a lower clipping member.
Figure 1C:
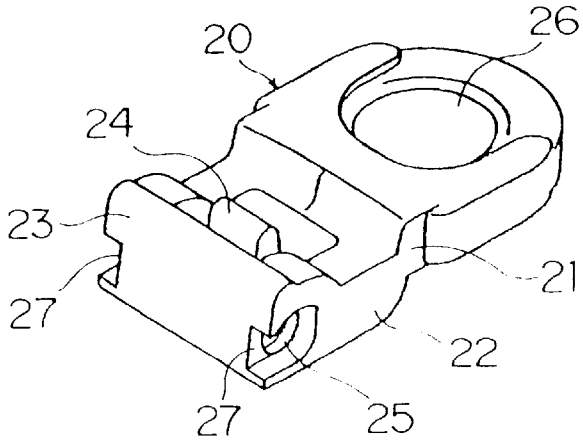
FIG. 1C is an exploded perspective view of a operation member.

FIG. 1A, FIG. 1B and FIG. 1C show exploded perspective views of a plastic clip developed by the present invention. FIG. 1A shows an upper clipping member (10), and FIG. 1B shows a lower clipping member (1), while FIG. 1C shows an operation member (20). With regard to FIG. 1C, this figure represents the back side so that components may be seen clearly.

Figure 2A:
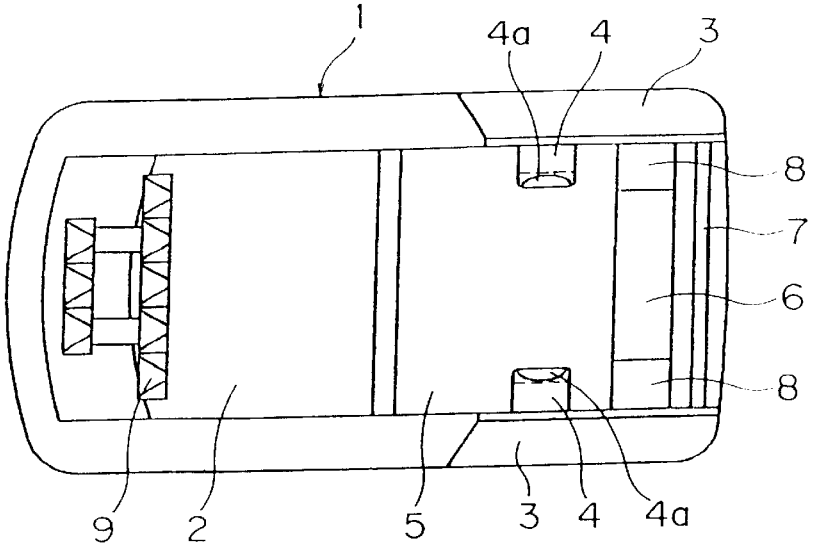
FIG. 2A is a plan view of the lower clipping member.
Figure 2B:
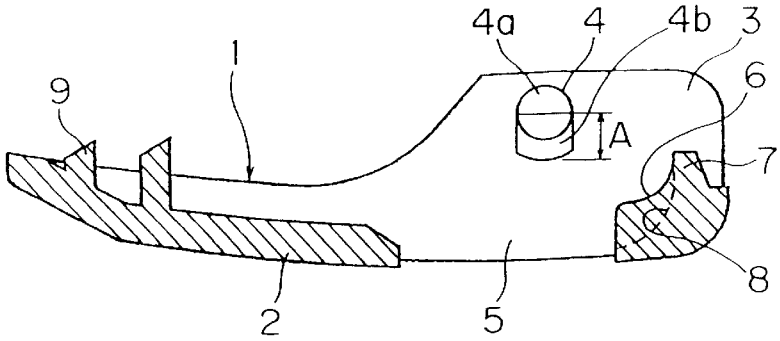
FIG. 2B is a longitudinal sectional view of the lower clipping member.
Figure 2C:
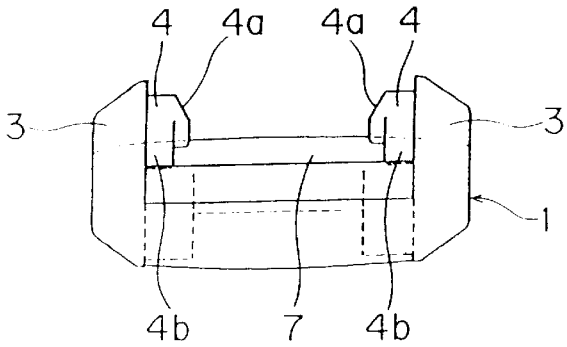
FIG. 2C is a rear elevational view of the lower clipping member.

As shown in FIG. 1B, FIG. 2A and FIG. 2B, the lower clipping member (1) has a square-like window (5) in the front area of a lower substrate (2) which is shaped like a circular of arch toward its top end. On both sides of the square-like window (5), a pair of side walls (3) are formed, while in its rear portion a rear wall (7) is formed lower than the side walls (3). An arcuate support shelf (6) is provided on front area of central portion of the rear wall (7), and on both sides of the arcuate support shelf (6) a first pair of arcuate surfaces (8) are formed along the line from a top end of the rear wall (7) and to a rear end of the window (5). In both inner surfaces of the side wall (3), a pair of pivot pins (4) are positioned above the arcuate support shelf (6).

Each pivot pin (4), as illustrated, has a slope (4*a*) in its upper portion and a bottom projection (4*b*) with the same width of the diameter of the pivot pin (4) in its lower portion which is placed against the side wall (3). The teeth (9) are prepared for the lower clipping member (1) on front area of the substrate (2).

Figure 3A:
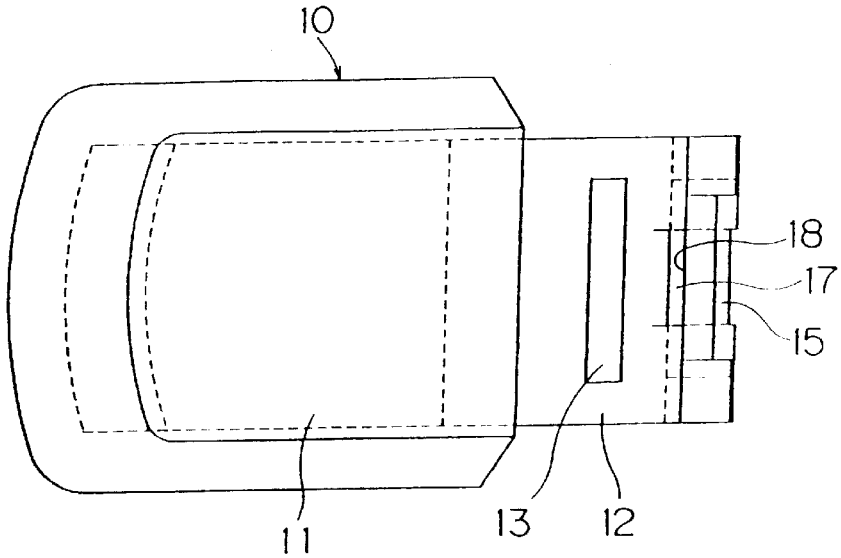
FIG. 3A is a plan view of the upper clipping member.
Figure 3B:
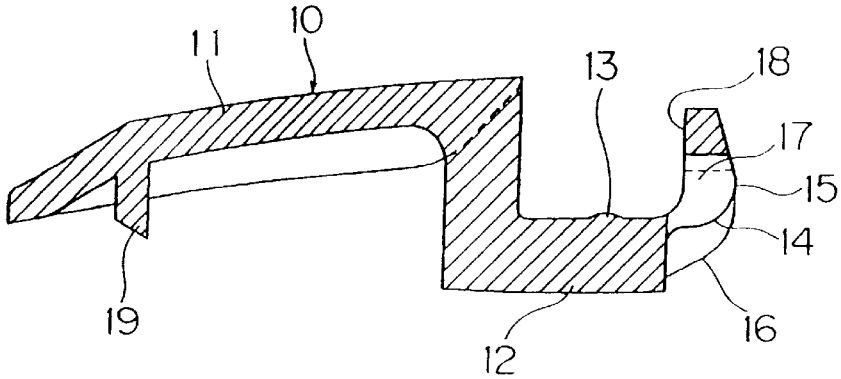
FIG. 3B is a longitudinal sectional view of the upper clipping member.
Figure 3C:
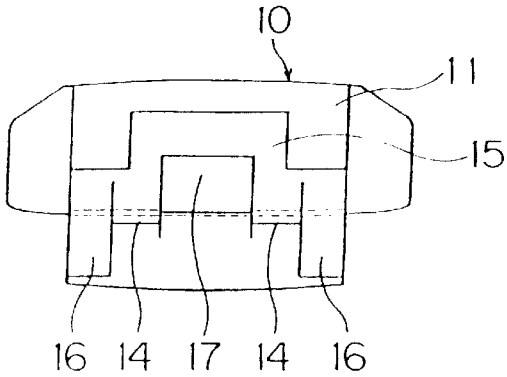
FIG. 3C is a rear elevational view of the lower clipping member.

As shown in FIG. 1A, FIG. 3A and FIG. 3B, the upper clipping member (10) has a recessed auxiliary plate (12) in rear area of a upper substrate (11), and this recessed auxiliary plate (12) is adapted to be inserted properly into the square-like window (5) of the lower clipping member (1). The rear wall (15) of the recessed auxiliary plate (12) extends outside, and, as shown in FIG. 3B and FIG. 3C, an arcuate bottom (14) is provided in the middle and outside areas of the rear wall (15), and the arcuate bottom (14) corresponds with the arcuate support shelf (6). A second pair of arcuate surfaces (16) which corresponds with a first pair of arcuate surfaces (8) is formed on both lower sides of the arcuate bottom (14), while a notch (17) is formed in the inside surface of the arcuate bottom (14) in its upper and central area.

The numeral (13) is a low projection in a quonset-hut shape, and it helps a rotation movement for the operation member (20). In reference with FIG. 3B, the teeth (19) are prepared in front area of the upper substrate (11) for the upper clipping member (10), which engage with the teeth (9) on the lower clipping member (1).

With reference to FIG. 1C, FIG. 4A, FIG. 4B and FIG. 4C, the operation member (20) has a strap insertion hole (26) in rear area of an operation substrate (21) which is shaped in a semi-circle. A back plate (22) is formed in the front area and it is adapted to be inserted between the pair of side walls (3). At the top end of a front wall (23) of the back plate (22) it is formed in arcuate shape. A tongue-like actuation cam (24) which is same height of the front wall (23) as top wall is prepared at a fixed distance from the wall (23) on central area of the wall (23), while the tongue-like actuation cam (24) is adapted to be fitted into the notch (17) of the upper clipping member (10). A pair of pivot pin receiver holes (25) into which is fitted a pair of the pivot pins (4) is established on both outer sides of the back plate (22).

As illustrated, the pivot pin receiver holes (25) have a pair of ditches (27) which are the same width as the diameter of the pivot pins (4) located on both outer sides of the front wall (23). In reference with FIG. 4B and FIG. 4D, a pair of guide ditches (28) is also provided to engage with the projection (4*b*) of the pivot pins (4).

Figure 4A:
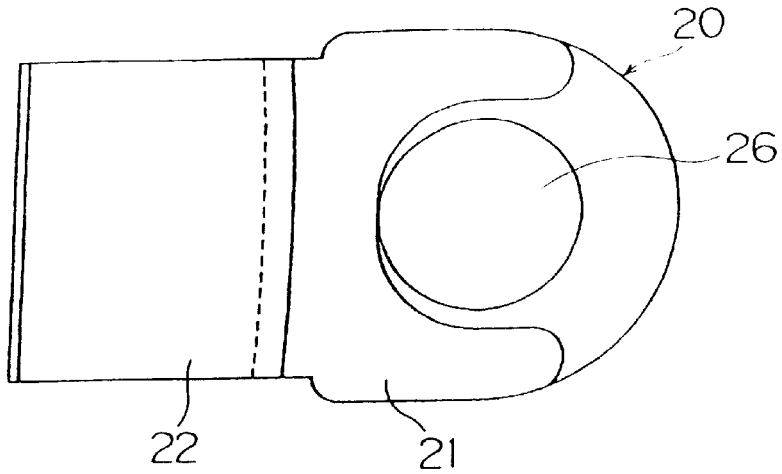
FIG. 4A is a plan view of the operation member.
Figure 4B:
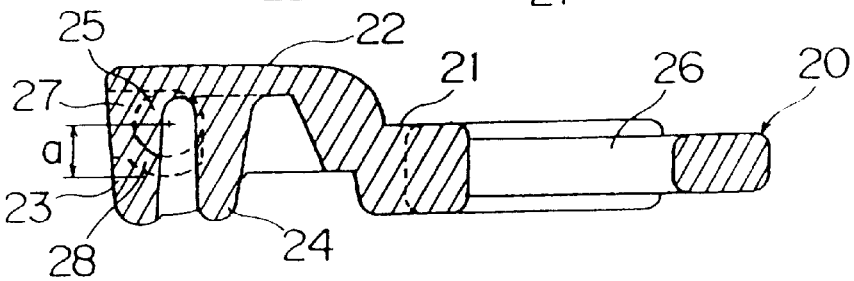
FIG. 4B is a longitudinal sectional view of the operation member.
Figure 4C:
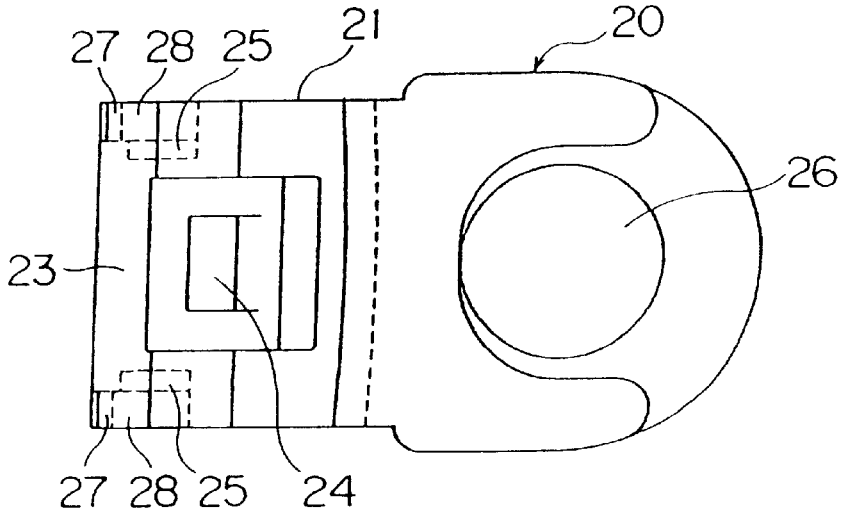
FIG. 4C is a bottom plan view of the operation member.
Figure 4D:
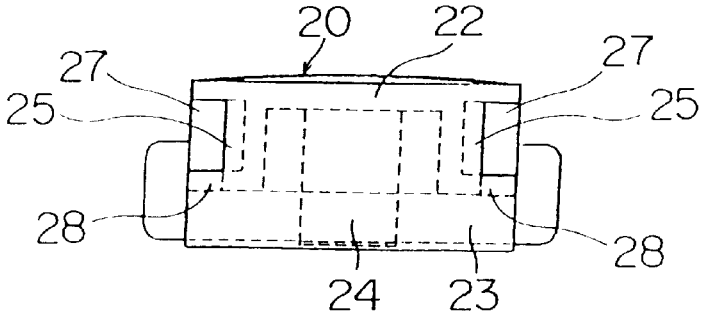
FIG. 4D is a front view of the operation member.

As shown in FIG. 4B, the radius of curvature (a) from center of the pivot pin receiver holes (25) in the guide ditches (28) is formed a little bit smaller (about 0.15 mm) than the radius of curvature (A) shown in FIG. 2B, and center position of the pivot pin receiver hole (25) and is maintained to locate above the radius of curvature for the arcuate bottom (14) at almost the same position of the rear surface of the front wall (23). Accordingly, as shown in FIG. 6B, when the arcuate bottom (14) is placed on the arcuate support shelf (6) and the operation member (20) is assembled in flat condition and upper surface of the recessed auxiliary plate (12) is pressed down in bottom area of the front wall (23), the top ends of the lower clipping member (1) and the upper clipping member (10) are pressed together.

The distance from the center of the pivot pin receiver holes (25) to the front face of the front wall (23) is decidedly shorter than that from said center to the bottom end of the front wall (23). As shown in FIG. 6B, a gap (29) is prepared between the recessed wall of the recessed auxiliary plate (12) and the front wall (23) of the operation member (20).

Figure 5A:
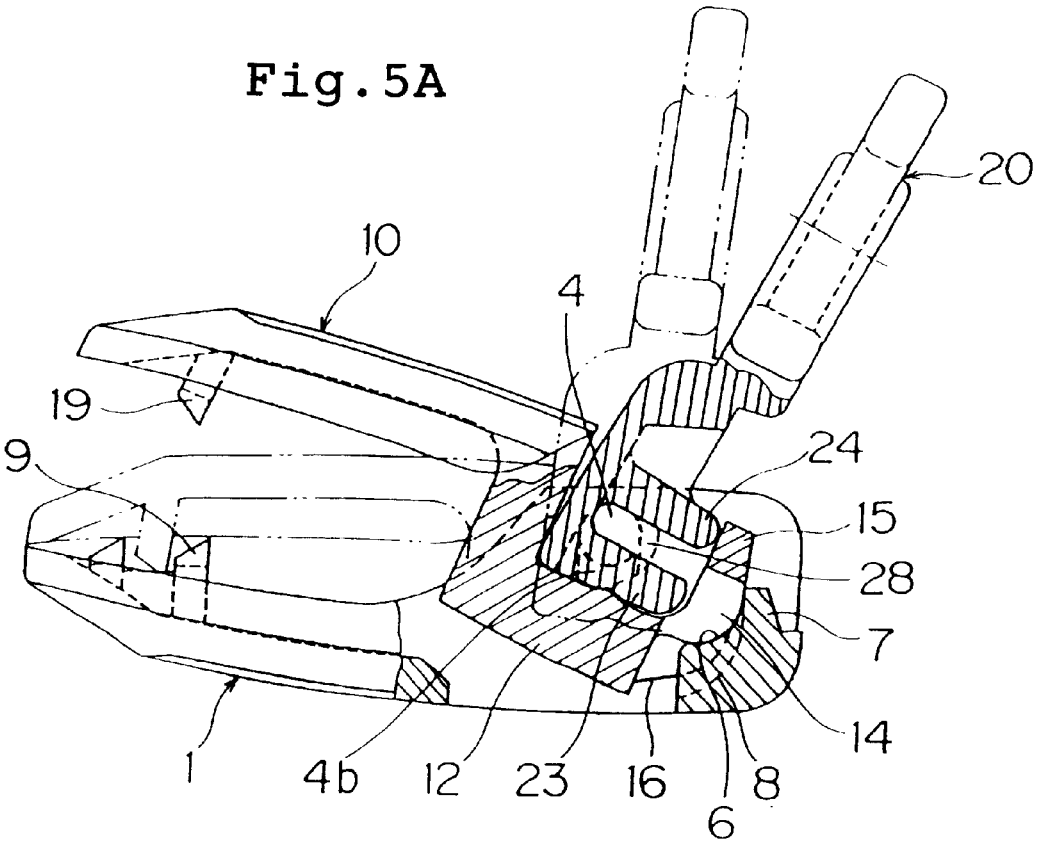
FIG. 5A is a longitudinal sectional view showing a condition when a clip is opened.
Figure 5B:
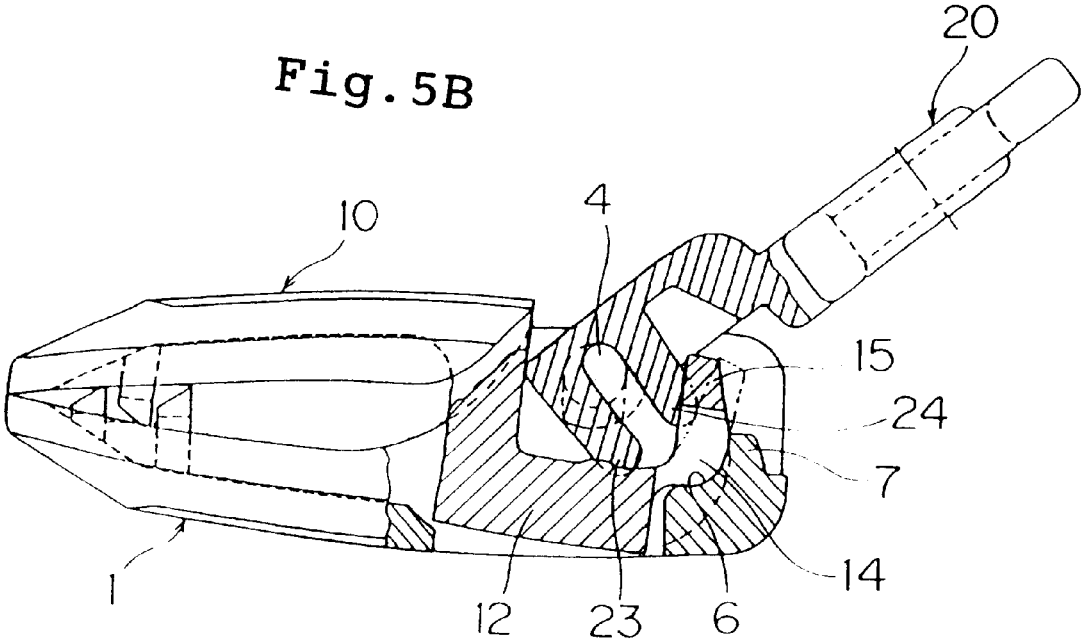
FIG. 5B is a longitudinal sectional view showing a condition when the clip is on the way to be opened or closed.
Figure 6A:
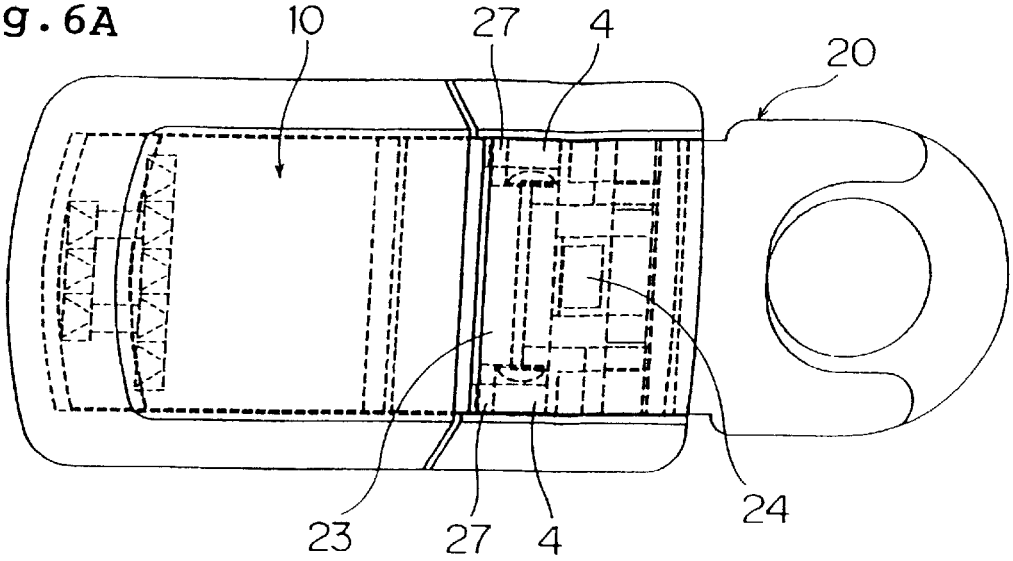
FIG. 6A is a plan view showing a condition when the clip is closed.
Figure 6B:
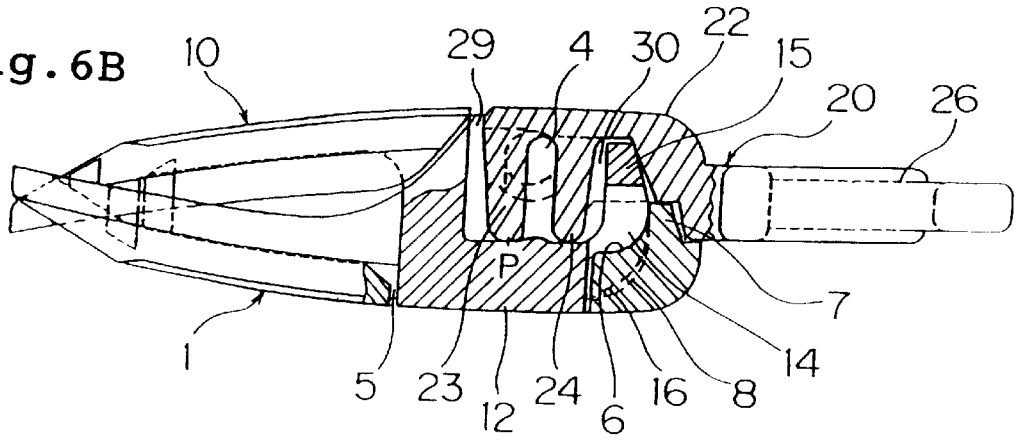
FIG. 6B is a longitudinal sectional view showing a condition when the clip is closed.
Figure 6C:
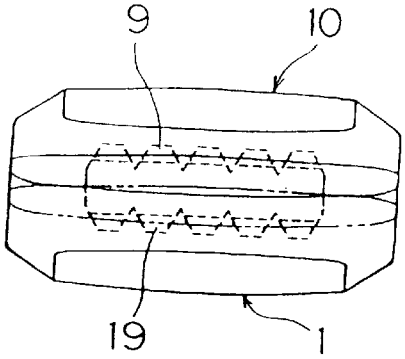
FIG. 6C is a front view showing a condition when the clip is closed.
Figure 6D:
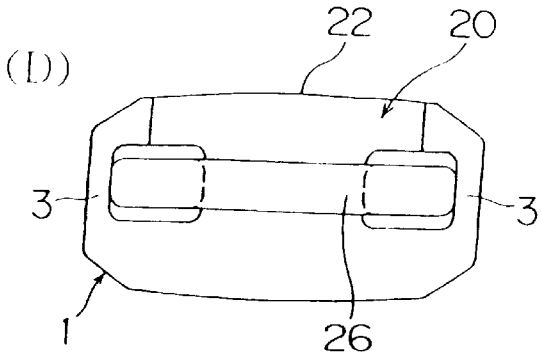
FIG. 6D is a rear elevational view showing a condition when the clip is closed.
Figure 7A:
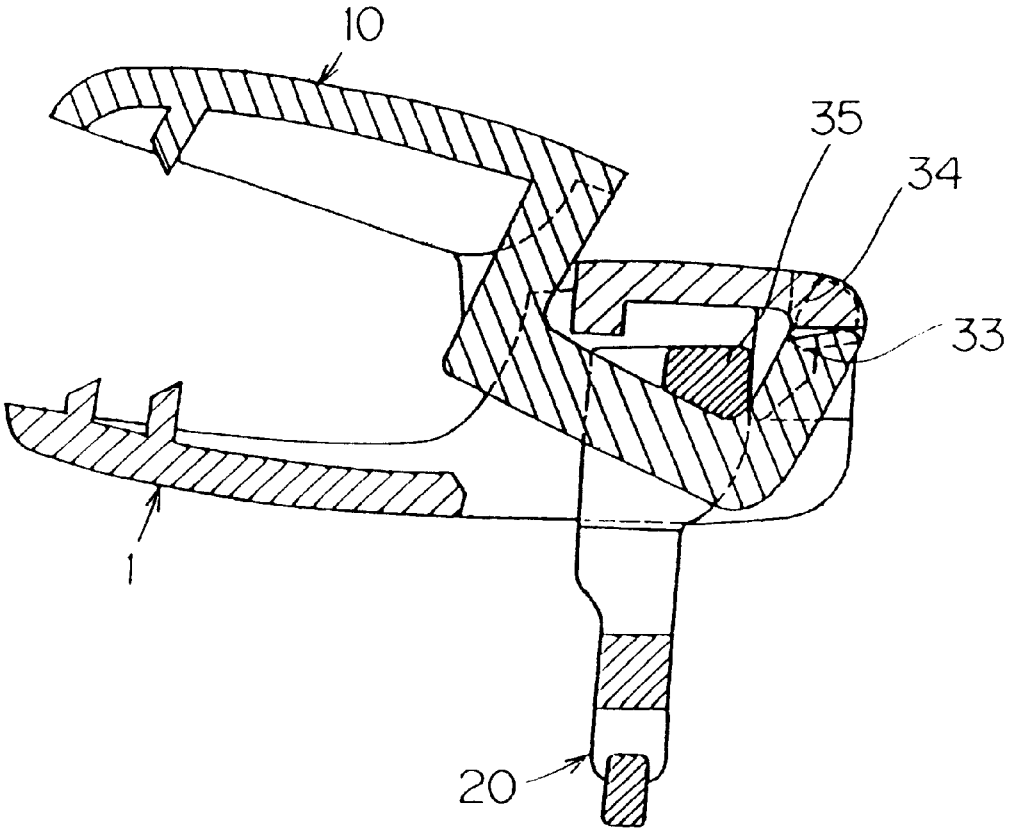
Fig. 7A PRIOR ART
FIG. 7A is a longitudinal sectional view of a prior art clip, showing a condition when the clip is opened.
Figure 7B:
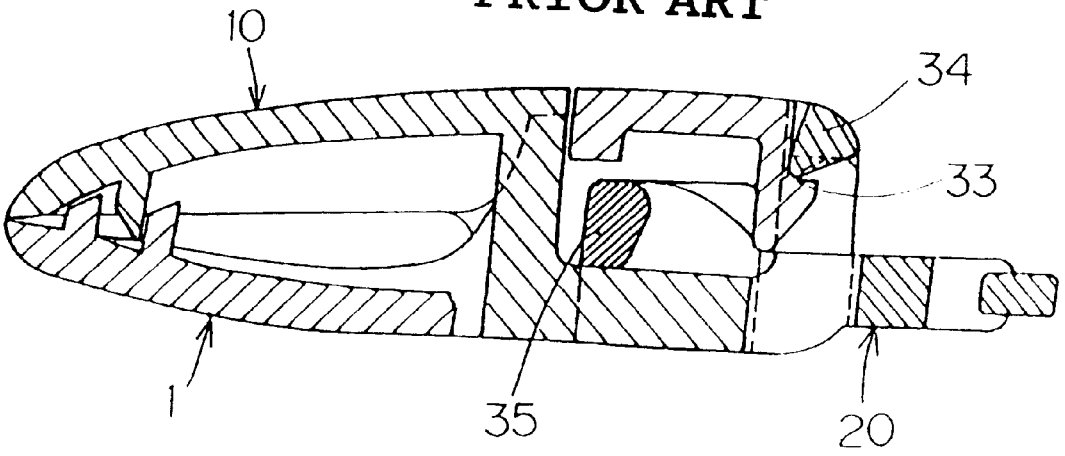
Fig. 7B PRIOR ART
FIG. 7B is a longitudinal sectional view of a prior art clip, showing a condition when the clip is closed.
Figure 8A:
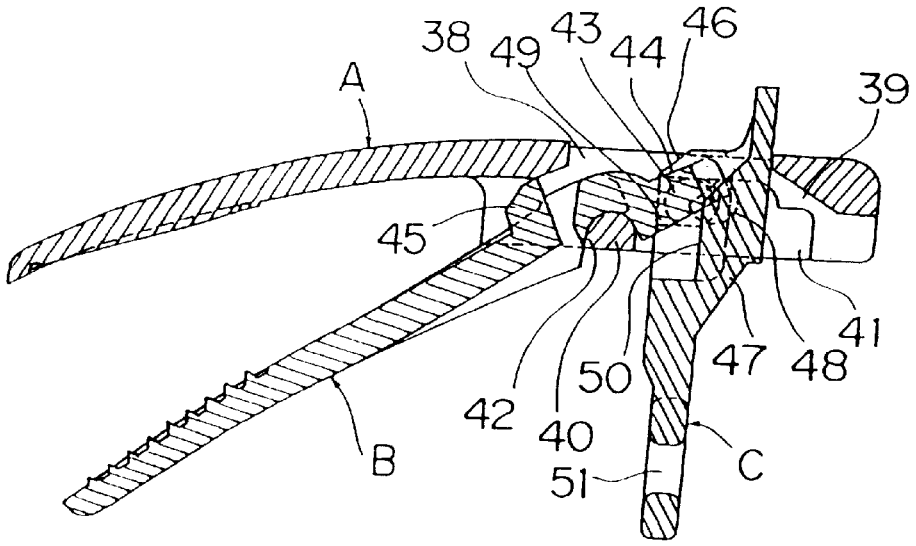
Fig.8A PRIOR ART
FIG. 8A is a longitudinal sectional view of another prior art clip, showing a condition when the clip is opened.
Figure 8B:
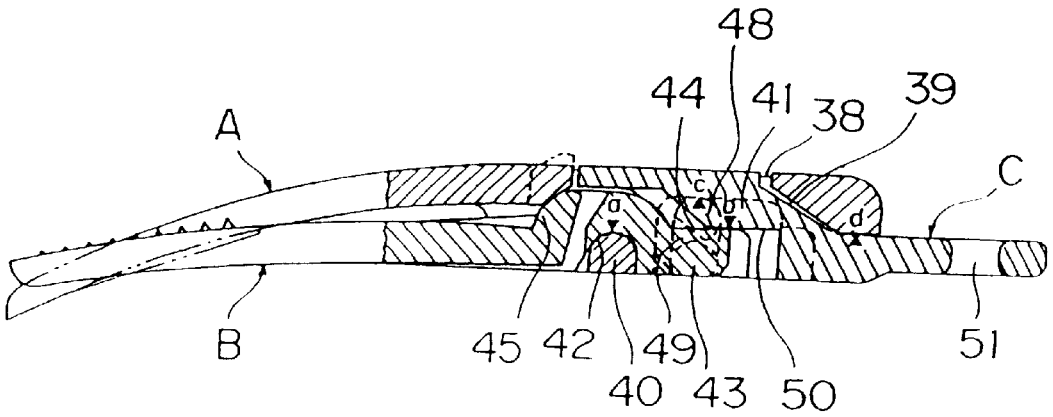
Fig.8B PRIOR ART
FIG. 8B is a longitudinal sectional view of another prior art clip, showing a condition when the clip is closed.

With reference to FIG. 5A, FIG. 5B and FIG. 6B, the front area of the operation member (20) can be rotated at a 90 degree angle sustained by the pivot pins (4) in the lower clipping member (1), while the low projection (13) on the recessed auxiliary plate (12) functions to rotate the operation member (20).

The measurement in the present embodiment for both the lower clipping member (1) and the upper clipping member (10) is 25 mm long by 15 mm wide, and total thickness of the present clip in closed condition is 8 mm while total length is 38 mm including the operation member (20).

With regard to the material to be adopted in this invention for producing all substrates and other parts, it is not specially limited, but it is recommended to use polycarbonate resin in view of its elasticity and durability.

Now, the assembling procedures are explained. As shown in FIG. 5A, the recessed auxiliary plate (12) of the upper clipping member (1) is inserted into the square-like window (5) of the lower clipping member (10), and the arcuate bottom (14) is placed on the arcuate support shelf (6). Then, the operation member (20) is erected horizontally and is inserted forcibly onto the pivot pins (4) aligning the pair of ditches (27) with the pivot pins (4). The member (20) is then turned to the right. Then the pivot pins (4) are fitted into the pivot pin receiver holes (25) through the slope (4*a*) by elastic power of plastic material itself. Now, parts of the bottom projections (4*b*) are forcibly fitted into the pair of guide ditches (28) of the operation member, and thus the front area of the operation member (20) is assembled with the recessed auxiliary plate (12).

In the condition of FIG. 5A, the pivot pins (4) are fitted into the pivot pin receiver holes (25) in a rotatable condition, and the bottom projections (4*b*) are fitted into the pair of guide ditches (28) with some pressure. The operation member (20) then receives some light pressure provided by the fulcrum point of the pivot pins (4). This provides for rotation, but the operation member (20) does not easily disconnect.

When the operation member (20) is turned down at the rear as shown in FIG. 5A, the upper area of the rear wall (15) is pushed and slides downward on the inner surface of the rear wall (15) in the bottom end of the tongue-like actuation cam (24). As shown in FIG. 6B, when the operation member (20) becomes flat, the operation member (20) presses the top surface of the recessed auxiliary plate (12) at the bottom area of the front wall (23), and thus the top ends of the lower clipping member (1) contact the upper clipping member (10) to provide pressure for closing.

During this closing procedure, the operation member causes a frictional contact at the low projection (13) of the recessed auxiliary plate (12) and even in the bottom area of the front wall (23). This frictional contact can be overcome by the flexibility of the front wall (23) and the upper clipping member (10).

The notch (17) located in the central area of the rear wall (15) provides the escape zone for the tongue-like actuation cam (24) when the operation member (20) is operated. The notch (17) also provides flexibility as a reaction bar on the central and upper areas of the rear wall (15). This notch (17) is not always necessary when proper plastic material is adopted or the shape of the rear wall (15) is devised in a different manner.

In the condition of FIG. 6B, a pressure point (P) existing on the bottom end of the front wall (23) top end and on the upper face of the auxiliary plate (12) stays in the front and lower areas of the pivot pins (4) to maintain a steady locking condition. At the same time, the gap (30) is provided between the rear surface of the tongue-like actuation cam (24) and the inner surface (18) of the rear wall (15), so that the hysteresis wear is prevented for both the tongue-like actuation cam (24) and the rear wall (15).

When the operation member (20) is lifted from the condition shown in FIG. 6B to the condition shown in FIG. 5A via the condition shown in FIG. 5B, the front face of the front wall (23) moves downward to remove the pressurized contact on the upper surface of the recessed auxiliary plate (12). This movement also pushes the inner surface (18) of the rear wall (15) rearward in the bottom end area of the tongue-like actuation cam (24), which results in lifting the upper clipping member (10) sustained by the fulcrum point of the arcuate bottom (14) and which finally separates the top ends of the lower clipping member (1) and of the upper clipping member (10).

With regard to the lower clipping teeth (9) and the upper clipping teeth (19) adopted in this invention, they can be substituted by elastic rubber plates.

The conception of the plastic clip developed by the present invention has been explained as above, and further we shall add following statements.

As shown in FIG. 5A, when the operation member (20) is turned down from the clip opening condition, the central and upper area of the rear wall (15) is flexibly pressurized rearward at the bottom end of the tongue-like actuation cam (24). Then, as shown in FIG. 5B, the operation member (20) works to pressurize the upper surface of the recessed auxiliary plate (12), and when the operation member (20)

becomes level, the top ends of the lower clipping member (1) and the upper clipping member (10) close together.

As shown in FIG. 6B, the bottom area (Point "P") of the front wall (23) which pressurizes the upper clipping member (10) is positioned at a place lower than the pivot pins (4). Therefore, the top end of the upper clipping member (10) is stably maintained in the closed condition sustained by the fulcrum point of the arcuate bottom (14).

On the contrary, when the operation member (20) is lifted from the level condition as shown in FIG. 6B, the pressurized power existing on the upper surface of the recessed auxiliary plate (12) by the lower end of the front wall is removed, and it pushes the rear wall (15) rearward at the bottom area of the tongue like actuation cam (24). Accordingly, as shown in FIG. 5A through FIG. 5B, the top end of the upper clipping member (10) is lifted and sustained by the arcuate bottom (14), and thus the top ends of the lower clipping member (1) and of the upper clipping member (10) are separated in the open position.

In this open condition, when the top ends of the clip are pinched by human fingers, the clip is easily closed, and when the fingers are removed, the closed condition is maintained as if some spring material is arranged therein.

In the present invention, the lower clipping member (1) and the upper clipping member (10) are assembled at their rear areas. The fulcrum point of the arcuate bottom (14) is kept in the vicinity of the rear area, and a wide angle for the clip in its open position can be obtained.

Further, the gap (30) is established between the rear surface of the actuation cam (24) and the inner surface of the rear wall (15), whereas the hysteresis wear of the actuation cam (24) and the rear wall (15) are avoided. This ensures good durability for the plastic clip of the present invention.

In this invention, a separate spring means for opening or closing the clip is not adopted, and the property of plastic material is utilized instead. The assembly becomes very simple and economical results can be also attained by a smaller number of parts and reduced assembly expense.

The square-like window (5) is filled with the auxiliary plate (12) and the outer appearance of the present clip has a flat and smooth surface when the clip is closed. Therefore, the design is very thin and smart with good ergonomics.

It is further understood by those skilled in the art that the foregoing description is a preferred embodiment of the disclosed goods and that various changes and modifications may be made in this invention without departing from the spirit and scope thereof.

What is claimed is:

1. A plastic clip having a lower clipping member, an upper clipping member and an operation member, the clip comprising:

a square-like window formed on a rear area of the lower clipping member;

a pair of side walls prepared on both sides of a window in the lower clipping member;

a rear wall lower than the pair of side walls which is established in the rear area of the window;

an arcuate support shelf formed on central and front areas of the rear wall;

a first pair of arcuate surfaces prepared on both sides of the rear wall;

a pair of pivot pins positioned in front of and higher than the arcuate support shelf and on inner surfaces of the pair of side walls;

a recessed auxiliary plate established on a rear area of the upper clipping member, which is adapted to be inserted into the square-like window;

a rear wall on the recessed auxiliary plate formed in an extending shape on the upper clipping member;

a second pair of arcuate surfaces on the upper clipping member which correspond to the first pair of the arcuate surfaces on both sides of the rear wall which are on both lower sides of an arcuate bottom of the upper clipping member;

a strap insertion hole formed in a rear area of the operation member;

an operation member back plate adapted to be inserted between the pair of side walls prepared in a front area of the operation member;

a front wall on the back plate having a top end in arcuate form;

a tongue-like actuation cam which is positioned at a distance from the front wall, in the central area of the front wall and located on the back plate;

a pair of pivot pin receiver holes which are adapted to receive the pair of pivot pins, wherein the pivot pin receiver holes are formed on both outer sides of the back plate;

wherein the recessed auxiliary plate is inserted into the square-like window and the arcuate bottom of the upper clipping member is placed on the arcuate support shelf;

wherein the pair of pivot pin receiver holes of the back plate of the operation member are placed around the pair of pivot pins on the pair of side walls of the lower clipping member and wherein the operation member is forcibly pressed downward;

wherein the top ends of the lower clipping member and the upper clipping members are pinched by elastic power of the plastic material at the bottom end of the front wall of the operational member for closing; and wherein, when the rear area of the operation member is moved in the upper area of the rear wall and is pressed forcibly onto the rear area at the bottom end of the actuation cam, opening the top ends of the lower clipping member and the upper clipping member is promoted by the force provided by a fulcrum function of the arcuate bottom.

2. The clip according to claim 1, wherein a gap between the tongue-like actuation cam and an inner surface of the rear wall of the upper clipping member is provided when the lower clipping member and the upper clipping member are closed, wherein hysteresis wear caused by the mutual interferences prevented.

3. The clip according to claim 1, wherein polycarbonate resin is used.

* * * * *